US006784352B2

(12) United States Patent
Suenaga

(10) Patent No.: US 6,784,352 B2
(45) **Date of Patent: *Aug. 31, 2004**

(54) DRUMHEAD AND MUTING STRUCTURE FOR ACOUSTIC AND ELECTRONIC PERCUSSION INSTRUMENTS

(75) Inventor: Yuichiro Suenaga, Hamamatsu (JP)

(73) Assignee: Yamaha Corporation (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/274,154

(22) Filed: Oct. 21, 2002

(65) Prior Publication Data

US 2003/0037660 A1 Feb. 27, 2003

Related U.S. Application Data

(63) Continuation of application No. 09/710,619, filed on Nov. 9, 2000, now Pat. No. 6,525,249.

(30) Foreign Application Priority Data

Nov. 15, 1999 (JP) ..... 11-324361

(51) Int. Cl.[7] ..... G10D 13/00

(52) U.S. Cl. ..... 84/411 R; 84/723; 84/730; 84/104; 84/411 M

(58) Field of Search ..... 84/723, 725, 730, 84/104, 411 R, 411 M, 414, 738

(56) References Cited

U.S. PATENT DOCUMENTS

| | | | | |
|---|---|---|---|---|
| 4,244,266 A | | 1/1981 | Hardy | |
| 4,589,323 A | | 5/1986 | Belli et al. | |
| 4,669,349 A | | 6/1987 | Hyakutake | |
| 4,828,907 A | | 5/1989 | Hayashi | |
| 5,042,356 A | | 8/1991 | Karch | |
| 5,105,710 A | | 4/1992 | Rothmel | |
| 5,293,000 A | * | 3/1994 | Adinolfi | 84/730 |
| 5,920,026 A | * | 7/1999 | Yoshino et al. | 84/738 |
| 5,977,473 A | | 11/1999 | Adinolfi | |
| 6,121,538 A | | 9/2000 | Yoshino et al. | |
| 6,175,068 B1 | * | 1/2001 | Belli | 84/414 |
| 6,525,249 B1 | * | 2/2003 | Suenaga | 84/411 R |

FOREIGN PATENT DOCUMENTS

| | | |
|---|---|---|
| DE | 1248448 | 8/1967 |
| DE | 8600342 | 2/1986 |
| DE | 19625570 | 1/1998 |

OTHER PUBLICATIONS

German Patent Office Communication dated Dec. 7, 2001 (w/ English translation).

* cited by examiner

*Primary Examiner*—Marlon Fletcher
(74) *Attorney, Agent, or Firm*—Dickstein, Shapiro, Morin & Oshinsky, LLP.

(57) ABSTRACT

An acoustic drum or electronic percussion instrument is constructed by a drumhead corresponding to a punching sheet on which plenty of apertures are formed and a cylinder covered with the drumhead being stretched under tension as well as a muting structure which is realized by a vibration absorption member and a support structure containing L-shaped support members and a support plate. Herein, the support members are detachably attached to an interior periphery of the cylinder to support the support plate, on which the vibration absorption member is mounted and is arranged in contact with a backside surface of the drumhead to absorb vibration of the drumhead whose surface is being struck by a drumstick or else. Using the muting structure, it is possible to actualize mute performance in which drum sounds are being muted by reduction of the vibration of the drumhead propagating into the air. It is possible to form plenty of projections on an upper surface of the vibration absorption member, or it is possible to provide a reinforce member being attached to the backside surface of the drumhead. In addition, it is possible to provide the support structure with a vertical adjustment function by which the vibration absorption member is manually moved in a vertical direction along the interior periphery of the cylinder, so that the vibration absorption member is selectively arranged in contact with the backside surface of the drumhead.

18 Claims, 6 Drawing Sheets

DRUMHEAD AND MUTING STRUCTURE FOR ACOUSTIC AND ELECTRONIC PERCUSSION INSTRUMENTS

CROSS REFERENCE TO RELATED APPLICATION

This application is a continuation of application Ser. No. 09/710,619, filed Nov. 9, 2000, the contents of which are incorporated herein by reference, now U.S. Pat. No. 6,525,249.

BACKGROUND OF THE INVENTION

1. Field of the Invention

This invention generally relates to acoustic drums and electronic percussion instruments, and particularly to drumheads and muting structures for reducing sounds in volume being produced by striking the acoustic drums and electronic percussion instruments.

This application is based on Patent Application No. Hei 11-324361 filed in Japan, the content of which is incorporated herein by reference.

2. Description of the Related Art

Conventionally, musicians and players use in practice drums whose drumheads have muting functions. Generally speaking, the drumheads correspond to sheet-shaped skins which are stretched to cover hollow cylinders to provide striking surfaces which are struck with drumsticks. Some of the drumheads having muting functions are designed such that vibration absorption members are arranged in contact with backside surfaces of the drumheads or skins whose surfaces are struck by the players. Due to provision of the vibration absorption members, it is possible to reduce the volume of the percussion sounds.

Another method for muting uses mute covers that cover the striking surfaces of the drumheads.

Further, musicians or engineers develop drumheads exclusively designed for reducing the volume of sounds. That is, mesh-formed skins are used as the drumheads to suppress propagation of vibrations which are caused by striking the surfaces of the drumheads and propagate into the air.

In the case of the drumheads having the aforementioned vibration absorption members in contact with the backside surfaces, the drumheads and vibration absorption members integrally vibrate together to bring great differences in vibration characteristics as compared with normal drumheads of acoustic drums which do not have the vibration absorption members. No problem may be raised when the aforementioned drumheads (namely, vibration-absorbing drumheads) are used to merely expect muting functions thereof. However, players feel a strangeness in playing drums having the vibration-absorbing drumheads because they exhibit great differences in striking actions (and striking feelings) as compared with the normal drumheads of acoustic drums. For this reason, it cannot be said that the drums having the vibration-absorbing drumheads are preferable for the players in practice of music.

In addition, the aforementioned mute covers differ from the normal drumheads in their materials. This results in great differences in striking actions as compared with normal drumheads. So, it cannot be said that the drums using the mute covers are preferable for players in practice of music.

Further, while some muting effects can be obtained using the mesh-formed skins, they provide greater bounces in striking actions of drumsticks as compared with the normal drumheads of the acoustic drums. As a result, the mesh-formed skins of the drumheads result in great differences in striking actions (and striking feelings) as compared with the normal drumheads of the acoustic drums.

SUMMARY OF THE INVENTION

It is an object of the invention to provide a drumhead and a muting structure that reduce the volume of sounds produced by striking an acoustic drum or an electronic percussion instrument without deterioration of striking actions and striking feeling for a player.

It is another object of the invention to provide a drumhead and a muting structure that provide desired striking actions in playing an acoustic drum or electronic percussion instrument which approximate the normal striking actions of acoustic drums.

An acoustic drum or an electronic percussion instrument of this invention is constructed by a drumhead corresponding to a punching sheet on which plenty of apertures are formed and a cylinder covered with the drumhead being stretched under tension as well as a muting structure which is realized by a vibration absorption member and a support structure containing L-shaped support members and a support plate. Herein, the support members are detachably attached to an interior periphery of the cylinder to support the support plate, on which the vibration absorption member is mounted and is arranged in contact with a backside surface of the drumhead to absorb vibration of the drumhead whose surface is being struck by a drumstick or else. Using the muting structure, it is possible to actualize mute performance in which drum sounds are being muted by reduction of the vibration of the drumhead propagating into the air.

The muting structure can be modified in a variety of ways. For example, it is possible to form plenty of projections on an upper surface of the vibration absorption member, or it is possible to provide a reinforce member being attached to the backside surface of the drumhead. In addition, it is possible to provide the support structure with a vertical adjustment function by which the vibration absorption member is manually moved in a vertical direction along the interior periphery of the cylinder, so that the vibration absorption member is selectively arranged in contact with the backside surface of the drumhead.

In the case of the electronic percussion instrument, a vibration detection sensor is attached to approximately a center of a lower surface of the support plate to detect vibration of the drumhead, by which electronic sound is to be produced. In addition, it is possible to provide a secondary vibration detection sensor which is attached to the interior periphery of the cylinder to detect its vibration, by which electronic sound is to be produced.

BRIEF DESCRIPTION OF THE DRAWINGS

These and other objects, aspects and embodiments of the present invention will be described in more detail with reference to the following drawing figures, of which.

DESCRIPTION OF THE PREFERRED EMBODIMENTS

This invention will be described in further detail by way of examples with reference to the accompanying drawings.

[A] First Embodiment

Figure 1:
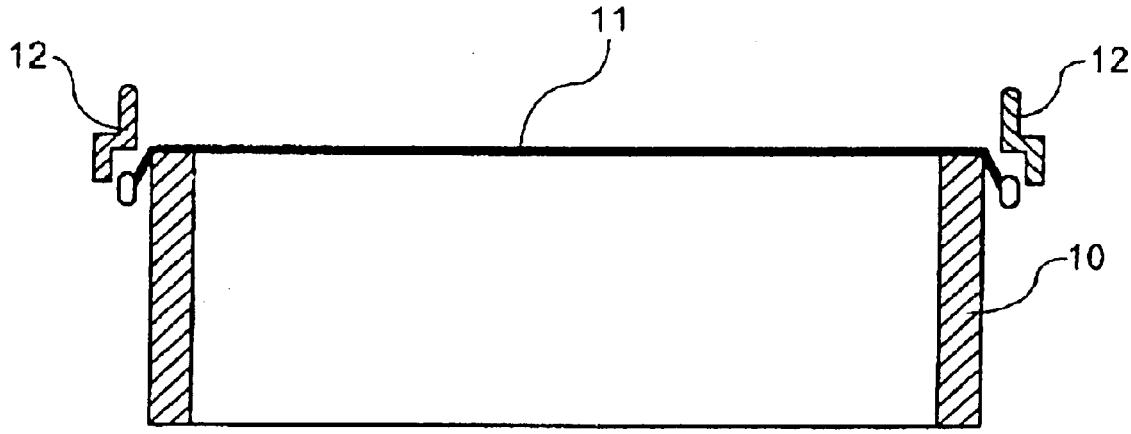
FIG. 1 is a traverse sectional view showing a construction of a drum in accordance with a first embodiment of the invention.

FIG. 1 diagrammatically shows a construction of a drum which is designed in accordance with a first embodiment of the invention. Namely, the drum of FIG. 1 is constructed by a hollow cylinder (or drum body) 10 and a sheet-shaped drumhead (or skin) 11. That is, the drumhead 11 is stretched to cover upper ends of the cylinder 10 such that a circumferential periphery of the drumhead 11 is tightly sandwiched between an exterior periphery of the cylinder 10 and rims 12 under tension. Herein, a player strikes a striking surface of the drumhead 11, which is stretched, with a drumstick (or drumsticks) to produce drum sounds. The first embodiment merely requires a normal drumhead as the drumhead 11. Namely, it is possible to use PET (i.e., polyethylene terephthalate) as material of the drumhead 11. In addition, it is possible to adjust tension and stretch of the drumhead 11 such that the rims 12 are moved up or down by means of a mechanism (not shown) to cause variations of a stretched state of the drumhead 11.

Figure 2:
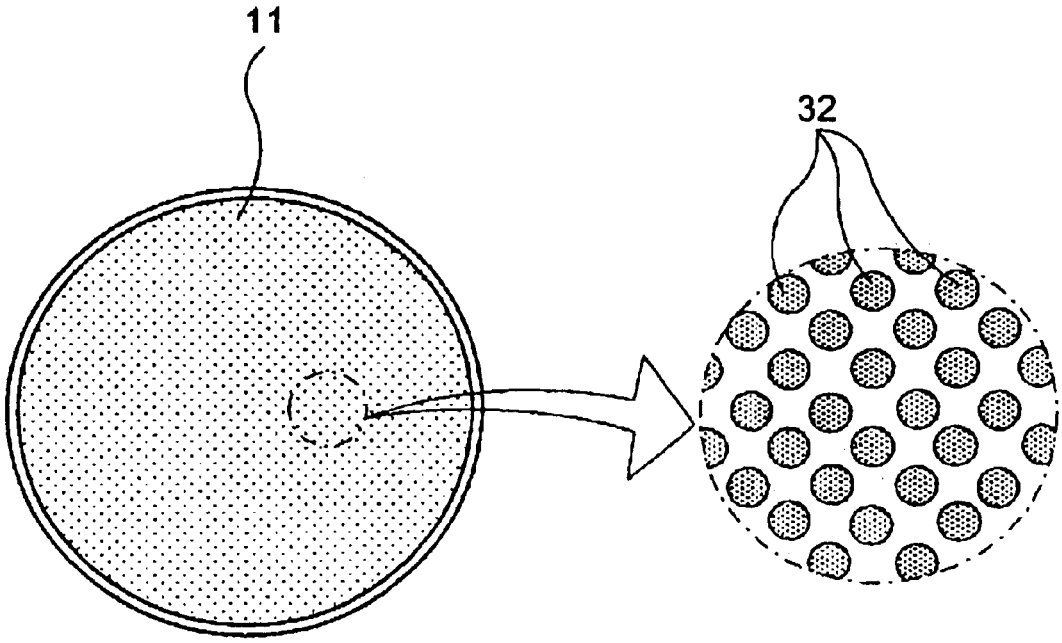
FIG. 2 shows enlarged and magnified images of a surface of a drumhead used in the drum shown in FIG. 1.

As described above, the drum of the first embodiment is basically similar to the known general-use drums in construction. Technical features of the first embodiment lie in formation of the drumhead 11. Details of the drumhead 11 will be described with reference to FIG. 2. As the drumhead 11, the first embodiment uses a porous sheet, namely, a punching sheet on which plenty of apertures (or small opening holes) 32 are formed. A diameter of each aperture ranges between several tenth milli-meter and several millimeters. Herein, an aperture degree (i.e., a total opening over an entire area of a sheet) is preferably set to 20% or so in consideration of muting effects, striking actions (or striking feeling) and strength. It is possible to adequately determine the aperture degree in response to various conditions of the drumhead 11 such as the material. To cope with striking using a normal drumstick, it is preferable that a diameter of the aperture 32 is set to several milli-meters or so. In the case of so-called brush performance using a brush for performance of the drum, it is preferable that a diameter of the aperture 32 ranges between 0.3 mm and 0.5 mm, for example.

When the player strikes the surface of the drumhead 11 using a drumstick or else, the drumhead 11 starts to vibrate. At this time, plenty of the apertures, which are formed on the drumhead 11, contribute to reduction of propagation of vibration which propagate from the drumhead 11 to the air. Thus, it is possible to reduce the sound volume. Conventionally, musicians or engineers develop drumheads that actualize muting functions by adopting mesh-formed materials. That is, the mesh-formed drumheads vibrate with bounces in striking actions as compared with the normal drumheads. So, the mesh-formed drumheads greatly differ from the normal drumheads of the acoustic drums in striking actions. As compared with the mesh-formed drumheads, the punching sheets (non-woven sheets having a striking surface in which a plurality of apertures are formed) produce small bounces, so it is possible to approximate their striking actions to normal striking actions of the acoustic drums. In addition, the first embodiment has an advantage in that by replacing the punching sheet with a normal sheet material for the drumhead 11, the drum of the first embodiment can be easily used as a standard acoustic drum. In other words, it is possible to switch between normal performance and mute performance in playing the drum with ease.

[B] Second Embodiment

Figure 3:
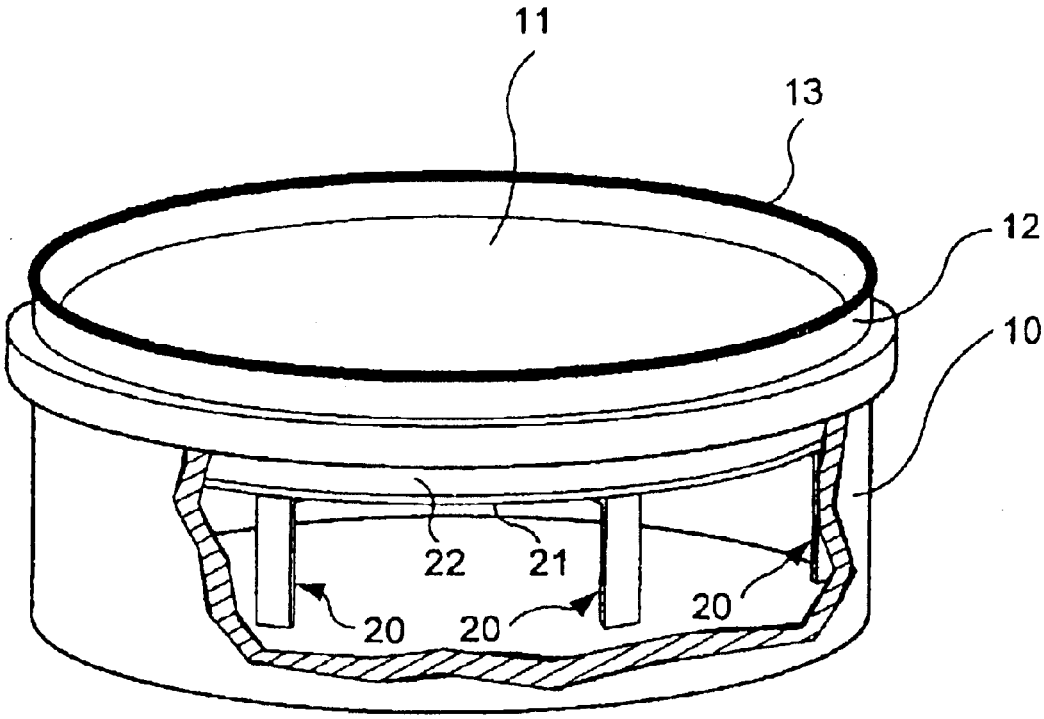
FIG. 3 is a perspective view partly in section showing a construction of a drum in accordance with a second embodiment of the invention.
Figure 4:
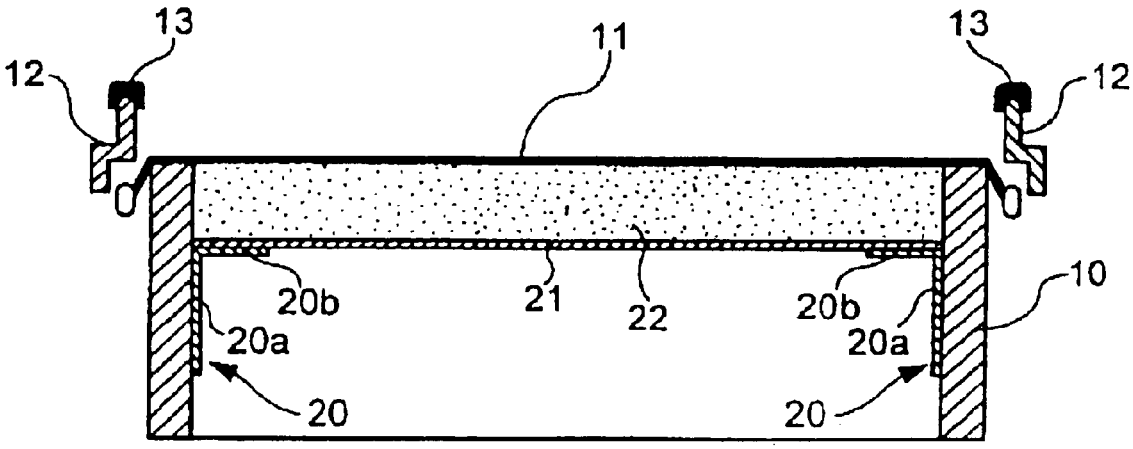
FIG. 4 is a traverse sectional view showing details in construction of the drum of the second embodiment.

Next, FIGS. 3 and 4 show the construction of a drum in accordance with a second embodiment of the invention, wherein parts identical to those of the first embodiment shown in FIG. 1 will be designated by the same reference numerals. As compared with the first embodiment, the second embodiment is further improved to approximate striking actions thereof to those of the acoustic drum. That is, the second embodiment installs a special construction, which will be described below.

The drum of the second embodiment is constructed to introduce L-shaped support members 20 which are fixed to several locations along an interior periphery of the cylinder 10. Namely, each of the support members 20 is constructed by a fixing portion 20*a* and a bent portion 20*b*. Herein, the fixing portion 20*a* is fixed to the interior periphery of the cylinder 10 at a prescribed location, and the bent portion 20*b* is bent from an upper portion of the fixing portion 20*a* in an inward direction toward a center of the cylinder 10. In addition, a disk-shaped support plate 21 made of aluminum is mounted on the bent portions 20*b* within the cylinder 10. As material of the support members 20, it is possible to use metal material or else which is hardly deformed by elasticity. Further, a vibration absorption member 22 made by sponge materials such as urethane sponge and rubber sponge or else is mounted on the support plate 21. The support members 20 support the vibration absorption member 22 via the support plate 21 such that an upper surface of the vibration absorption member 22 is arranged in contact with a backside surface of the drumhead 11. Herein, the drumhead 11 and the vibration absorption member 22 are not bonded together by adhesive. That is, the support members 20 supports the vibration absorption member 22 to be merely arranged in contact with the backside surface of the drumhead 11.

Incidentally, rim cushions 13 made by rubber are provided on the rims 12 respectively. Due to provision of the rim cushions 13, it is possible to attenuate rim-shot sounds.

When a player strikes the surface of the drumhead 11 using a drumstick or else, the drumhead 11 starts to vibrate. As similar to the first embodiment, the large number of apertures 32 formed on the drumhead 11 contribute to reduction of propagation of vibration which propagate from the drumhead 11 to the air. Thus, it is possible to reduce sound volume. As described above, compared with the mesh-formed drumhead, the punching sheet produces small bounces in striking actions. Hence, it is possible to approximate striking actions of the drum of the second embodiment to those of the acoustic drum. Strictly speaking, however, the punching sheet suffers from unwanted small bounces in striking actions which the normal sheet-shaped drumhead of the acoustic drum do not produce.

To cope with the aforementioned matter, the second embodiment is constructed such that the vibration absorption member 22 is arranged in contact with the backside surface of the drumhead 11. That is, the vibration absorption member 22 absorbs bounces of the drumhead 11 effectively. This allows the second embodiment to further approximate the striking actions of the standard acoustic drum. As described above, the second embodiment provides desired striking actions (or striking feeling for the player) which are further approximated to those of the acoustic drum. Because the second embodiment employs a simple structure in which the drumhead 11 and the vibration absorption member 22 are not bonded together, it is possible to easily construct the drum of the second embodiment by additionally assembling the support members 20, support plate 21 and vibration absorption member 22 together with parts of the drum of the first embodiment.

[C] Third Embodiment

Next, a drum of a third embodiment of the invention will be described with reference to FIG. 5. As compared with the drum of the second embodiment, the drum of the third embodiment is characterized by that the vibration absorption member 22 is replaced by a vibration absorption member 42 in which plenty of irregularities (namely, projections 43) are formed on an upper surface. Other elements of the configuration of the drum of the third embodiment shown in FIG. 5 are identical to those of the drum of the second embodiment shown in FIGS. 3 and 4, hence, the duplicate description will be omitted.

Figure 5:
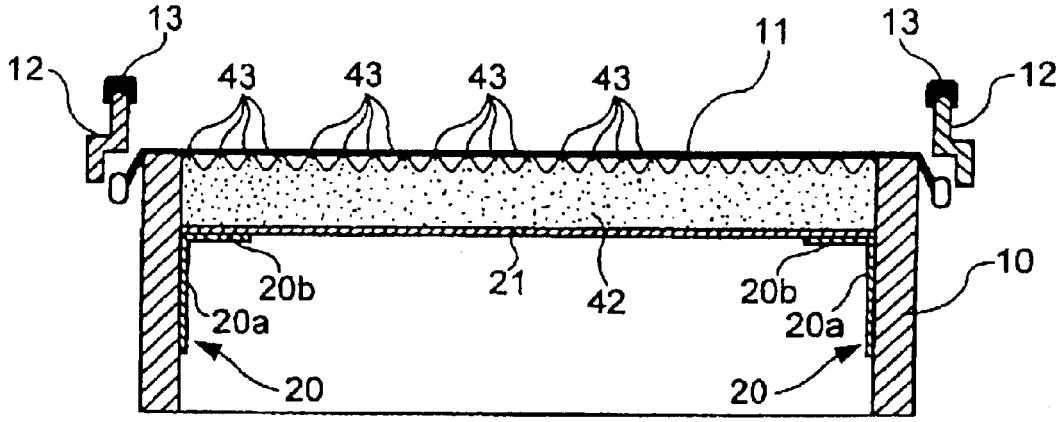
FIG. 5 is a traverse section view showing a construction of a drum in accordance with a third embodiment of the invention.

In the drum of the third embodiment shown in FIG. 5, plenty of projections 43 are formed on the upper surface of the vibration absorption member 42 which is placed to oppositely face with the backside surface of the drum head 11. In addition, the vibration absorption member 42 is supported by the support members 20 and the support plate 21 such that the projections 43 of the vibration absorption member 42 are arranged in contact with the backside surface of the drumhead 11. That is, as compared with the second embodiment, the third embodiment is characterized by reducing an entire contact area of the drumhead 11 that is placed in contact with the vibration absorption member.

By using the vibration absorption member 42 specially designed for the third embodiment, it is possible to obtain additional effects in addition to the foregoing effects of the second embodiment, as follows:

Basically, the present invention has a property in that the drumhead 11 is not bonded together with the vibration absorption member but is merely arranged in contact with the vibration absorption member. Due to such property of the present invention, when the player strongly strikes the drumhead 11 with a drumstick or else, the drumhead 11 strongly collides with the vibration absorption member to produce unwanted sound or so-called whipcrack. The third embodiment is capable of reducing the whipcrack in volume by using the vibration absorption member 42 having an upper contact surface on which plenty of projections 43 are formed and which is arranged in contact with the backside surface of the drumhead 11. In addition, the vibration absorption member 42 has certain elasticity by which it is possible to reduce rebounds of the drumhead 11. In short, the third embodiment is capable of controlling behavior or motion of the drumhead 11 not to increase or enlarge the rebounds so much. Thus, it is possible to obtain desired striking actions which well approximate the striking actions of the acoustic drum.

[D] Fourth Embodiment

Figure 6:
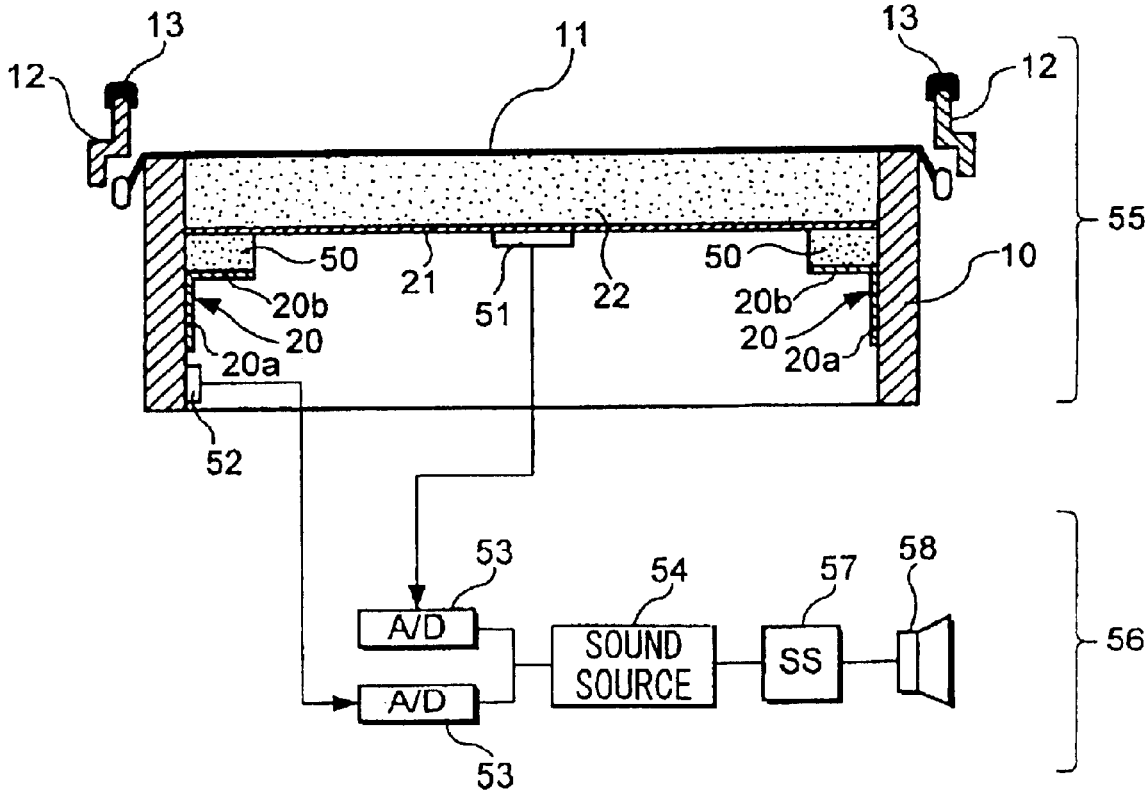
FIG. 6 shows a mechanical construction of a drumhead section and an electronic configuration of an electronic musical tone generation section within an electronic percussion instrument in accordance with a fourth embodiment of the invention.

Next, a fourth embodiment of the invention provides an electronic percussion instrument installing a drumhead, which will be described with reference to FIG. 6. In FIG. 6, parts identical to those of the foregoing second embodiment of FIGS. 3 and 4 will be designated by the same reference numerals, hence, the duplicate description will be omitted.

As shown in FIG. 6, the electronic percussion instrument of the fourth embodiment is basically constructed by two sections, namely, a drumhead section 55 and an electronic musical tone generation section 56. The drumhead section 55 is basically constructed as similar to the foregoing drum of the second embodiment by a cylinder (or drum body) 10, a drumhead 11, rims 12, rim cushions 13, support members 20, a support plate 21 and a vibration absorption member 22. So, the following description will be given with respect to differences between the second and fourth embodiments. In the drumhead section 55, the support plate 21 is mounted on bent portions 20*b* of the support members 20 by way of cushion materials 50. In contrast to the second embodiment, the fourth embodiment allows vibration of the support plate 21 by the aforementioned construction. Incidentally, the fourth embodiment merely needs elastic materials that allow vibration of the support plate 21. Hence, the fourth embodiment is not necessarily limited to use the cushion materials 50. Instead of the cushion materials 50, it is possible to use springs that provide elasticity or flexibility between the support members 20 and the support plate 21.

A vibration detection sensor 51 which is configured by a piezoelectric element and other circuit elements is attached to a lower surface of the support plate 21. The vibration detection sensor 51 detects vibration of the support plate 21 to produce electric signals, which are supplied to the electronic musical tone generation section 56. In order to accurately detect the vibration of the support plate 21 which vibrates when the drumhead 11 is struck by a drumstick or else, it is preferable that the vibration detection sensor 51 is attached to a center of the lower surface of the support plate 21. In addition, another vibration detection sensor 52 which is configured by a piezoelectric sensor and other circuit elements is also attached to a prescribed location of an interior periphery of the cylinder 10. The vibration detection sensor 52 detects vibration of the cylinder 10, which is caused by striking the rim(s) 12 with the drumstick or else, to produce electric signals which are supplied to the electronic musical tone generation section 56. By provision of the cushion materials 50 between the support members 20 and the support plate 21, it is possible to allow vibration of the support plate 21, which is a detected subject of the vibration detection sensor 51, to some extent. In addition, it is possible to prevent vibration of the drumhead 11 from propagating toward the vibration detection sensor 52, and it is possible to prevent vibration of the cylinder 10, which is caused by striking the rim(s) 12 with the drumstick or else, from propagating toward the vibration detection sensor 51.

The electronic musical tone generation section 56 installs analog-to-digital converters 53 for converting outputs of the vibration detection sensors 51, 52 to digital signals respectively, as well as a sound source device 54, a sound system 57 and a speaker 58. Herein, the sound source device 54 generates musical tone signals based on vibration of the drumhead 11 detected by the vibration detection sensor 51 and vibration of the cylinder 10 detected by the vibration detection sensor 52. The musical tone signals are supplied to the sound system 57, which produces corresponding musical tones by the speaker 58. Thus, the electronic musical tone generation section 56 electronically generates musical tones in response to striking actions applied to the drumhead 11 by the player.

As described above, the electronic percussion instrument of the fourth embodiment is capable of electronically generating musical tones in response to striking actions applied to the drumhead 11 by the player. In addition, as similar to the second embodiment, the fourth embodiment is capable of reducing the musical tones in volume. Of course, the fourth embodiment is designed not to damage the striking actions (or striking feeling of the player) so much. Because of the structure of the drumhead section 55 in which the support plate 21 is mounted on the support members 20 by way of the cushion materials 50, it is possible to allow vibration of the support plate 21 to some extent when the drumhead 11 is struck. Due to mechanical allowance for the vibration of the support plate 21 which is caused to occur when the player strikes the drumhead 11 by the drumstick or else, the vibration detection sensor 51 can accurately detect vibration of the drumhead 11 by means of the support plate 21. In addition, the electronic musical tone generation section 56 can electronically generate musical tones accurately in response to striking actions applied to the drumhead 11. Further, the fourth embodiment installs the vibration detection sensor 52, which is attached to the interior periphery of the cylinder 10 and by which the electronic musical tone generation section 56 can electronically generate sounds in consideration of striking actions applied to the rim(s) 12. Of course, it is possible to simplify the construction of the fourth embodiment by excluding the vibration detection sensor 52 and its related parts.

In addition, the fourth embodiment can be modified to employ the vibration absorption member 42 having the projections 42 in the drumhead section 55 as similar to the third embodiment shown in FIG. 5.

[E] Modifications

The present invention is not necessarily limited to the foregoing embodiments. Hence, it is possible to propose a variety of modifications with regard to the mechanical construction of the drum, which will be described below.

(1) The foregoing embodiments are designed such that the support plate 21 having a disk shape is used to support an entire area of a lower surface of the vibration absorption member 22 or 42. The present invention is not necessarily limited to the foregoing embodiments. That is, it is possible to employ a frame having a specific shape such as a cross shape or star shape for partially supporting the lower surface of the vibration absorption member. In addition, the frame is not necessarily made by the aforementioned material of aluminum. That is, it is possible to employ synthetic resin or wood material for formation of the frame. Further, the foregoing embodiments can be modified to exclude the support plate 21, so that the vibration absorption member 22 or 42 is directly mounted on and supported by the support members 20.

(2) The foregoing embodiments are modified to use screws for fixing the support members 20 to the interior periphery of the cylinder 10. In that case, it is possible to freely remove the support members 20, support plate 21 and vibration absorption member 22 from the cylinder 10 by releasing the screws according to needs. Namely, it is possible to modify the embodiments such that a muting structure corresponding to the support members 20, support plate 21 and vibration absorption member 22 are detachably attached to and installed in the cylinder 10. So, the muting structure employed in the foregoing embodiments can be independently used as a muting device which can be additionally installed in an acoustic percussion instrument such as an acoustic drum for producing normal drum sounds.

Figure 7:
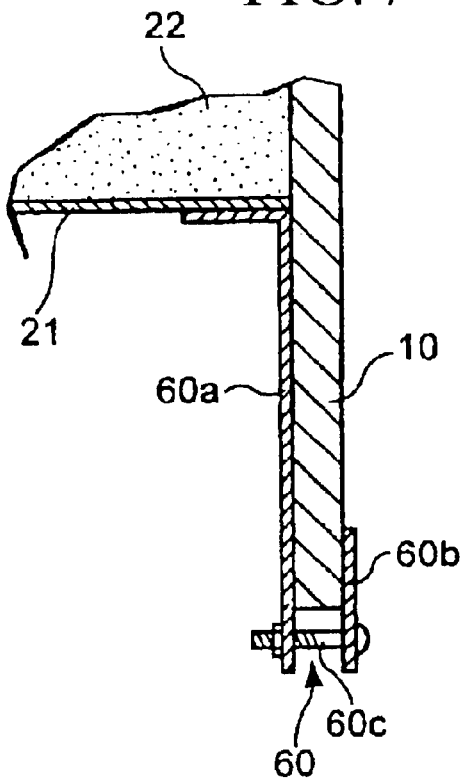
FIG. 7 is an enlarged sectional view showing a construction of a support structure and its related parts in a muting structure.
Figure 8:
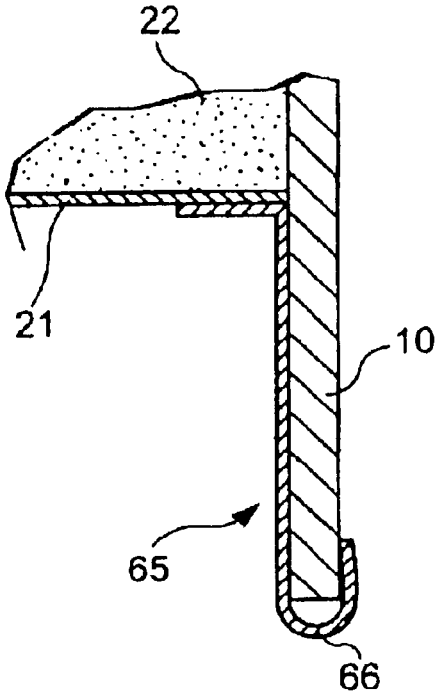
FIG. 8 is an enlarged sectional view showing a construction of a modified support member and its related parts in the muting structure.

(3) The foregoing embodiments employ a support structure realized by the support members 20 that are attached to the interior periphery of the cylinder 10 to support the support plate 21 and the vibration absorption member 22 or 42 thereon. It is possible to employ another type of the support structure, namely, a support structure 60 which is shown in FIG. 7 to support the support plate 21 and the vibration absorption member 22 thereon. The support structure 60 is mainly constructed by an L-shaped support portion 60*a* and a hold portion 60*b*. The support portion 60*a* is arranged along the interior periphery of the cylinder 10 while the hold portion 60*b* is arranged along the exterior periphery of the cylinder 10. Hence, a wall of the cylinder 10 is sandwiched between the support portion 60*a* and the hold portion 60*b*, which are fixed together by a screw 60*c*. Thus, the support portion 60*a* is firmly fixed to the cylinder 10 at a prescribed location. The support structure 60 for supporting the support plate 21 and the vibration absorption member 22 can be easily attached to and detached from the cylinder 10. In addition, the support structure 60 does not need a tapped hole for fixation to the cylinder 10. The aforementioned muting structure is constructed such that the drumhead 11 and the vibration absorption member 22 are not bonded together by adhesive but they are merely arranged in contact with each other. By using the support structure 60, it is possible to additionally install the muting structure to any types of drums, which are normally sold on the market, with ease and without modifications. Incidentally, the support structure 60 is fixed to the cylinder 10 by tightly sandwiching its wall between the support portion 60*a* and hold portion 60*b* by means of the screw 60*c*. Instead of the support structure 60 using the screw 60*c* for fixation, it is possible to employ a support member 65 that uses a U-shaped hook portion 66 shown in FIG. 8. That is, a lower end portion of the L-shaped support member 65 is partially folded back to form the U-shaped hook portion 66, by which the support member 65 as a whole is hooked on the wall of the cylinder 10. Herein, the hook portion 66 has elasticity for holding the wall of the cylinder 10 therein. By adjusting the hook portion 66 in position, it is possible to fixedly attach the support member 65 to the cylinder 10 at a prescribed location. As compared with the aforementioned support structure 60, the support member 65 is somewhat improved in attachment that it can be detachably attached to the cylinder 10 very easily.

Figure 9:
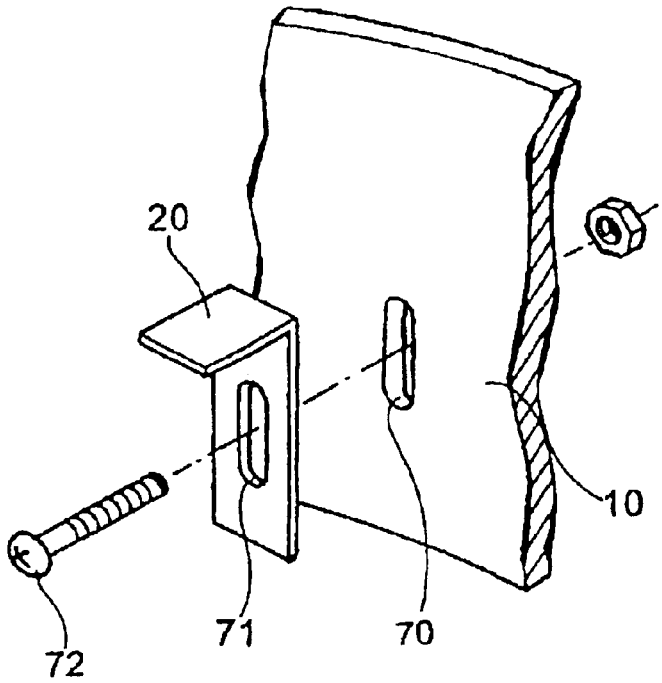
FIG. 9 is an exploded view showing parts of a modified support structure in the muting structure.
Figure 10:
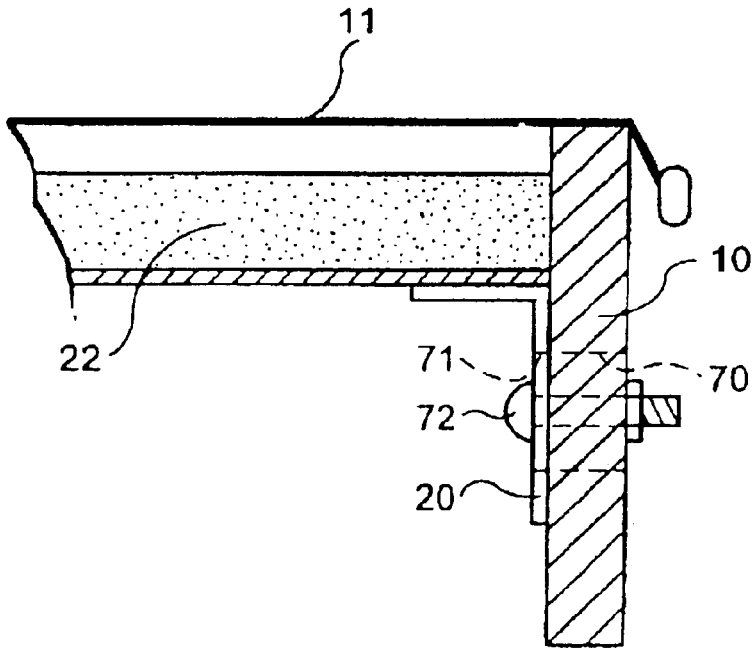
FIG. 10 is an enlarged sectional view showing the parts of the modified support structure being assembled together with other parts of the muting structure.

(4) As described above, the muting structure of the present invention can be easily installed in the acoustic drum by means of the support members or support structure. In that case, the support member 20 is attached to the wall of the cylinder 10 such that it is able to move in a vertical direction within a prescribed range, which is realized by FIGS. 9 and 10, for example. That is, a vertically elongated through hole 70 is formed to penetrate through the wall of the cylinder 10, and a vertically elongated hole 71 is formed on the support portion 20*a* of the support member 20, wherein those holes 70 and 71 substantially match with each other in shape and size. Within a range of opening of the holes 70 and 71, the support member 20 is fixed to the wall of the cylinder 10 at an arbitrary location by a screw 72. Thus, it is possible to easily adjust a fixing position of the support member 20 in a vertical direction with respect to the wall of the cylinder 10. Herein, the support member 20 is arranged at a mute position such that an upper surface of the vibration absorption member 22 is brought into contact with the backside surface of the drumhead 11, so that mute performance of the drum is to be realized by reducing sounds in volume. In order to produce normal sounds without muting, the support plate 20 is moved downwardly to be lower than the mute position corresponding to the mute performance of the drum. Lowering the fixing position of the support member 20 cause the support plate 21 and vibration absorption member 22 to be lowered in elevation so that the vibration absorption member 22 is placed not to be in contact with the drumhead 11. This inactivates the muting structure to realize normal performance of the acoustic drum. That is, when the player strikes the surface of the drumhead 11 by the drumstick or else under the aforementioned condition, the drumhead 11 vibrates to produce normal sounds without muting as similar to the normal acoustic drum. By providing a vertical adjustment by which the support member 20 is freely moved in the vertical direction along the wall of the cylinder 10, it is possible to easily switch operation of the drum between the mute performance and normal performance in playing. Incidentally, the vertical adjustment is not necessarily limited to one as shown in FIGS. 9 and 10, in which the support member 20 is manually adjusted in position in the vertical direction along the wall of the cylinder 10. For example, it is possible to employ motor drive for the vertical adjustment. Or, it is possible to employ a mechanical transmission mechanism which is interlocked with a handle or lever being rotated by a user so that the support member 20 is vertically adjusted in position.

(5) The vibration absorption member is not necessarily formed in a single layer having a prescribed elastic modulus. That is, it is possible to employ a laminated structure constructed by multiple layers of different materials having different elastic modulus.

Figure 11:
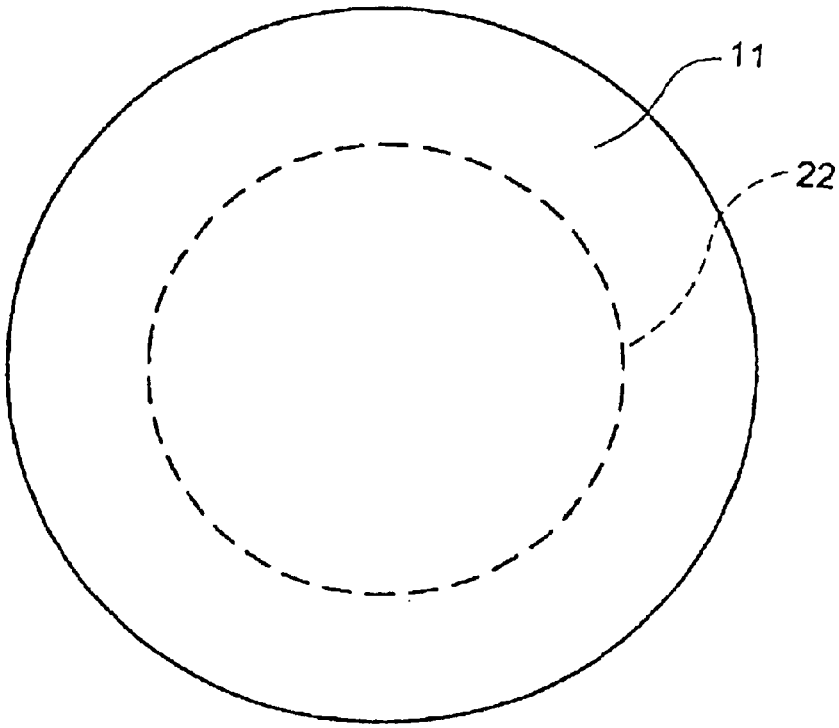
FIG. 11 is a plan view showing a surface of a drumhead in connection with a vibration absorption member having a reduced size.

(6) The foregoing embodiments are constructed to use the vibration absorption member 22 whose circular surface area substantially matches with an effective surface area of the drumhead 11 in dimensions. It is possible to form the vibration absorption member 22 in different size or shape. For example, it is possible to form the vibration absorption member 22 in a small size which is smaller than the size of the drumhead 11 as shown in FIG. 11, wherein an upper surface of the vibration absorption member 22 is placed in contact with a part (encompassed by a dotted line) of the drumhead 11. Incidentally, it is not necessary to form the vibration absorption member 22 in a circular shape in plan view. Hence, it is possible to form it in other shapes such as a square shape or a rectangular shape.

Figure 12:
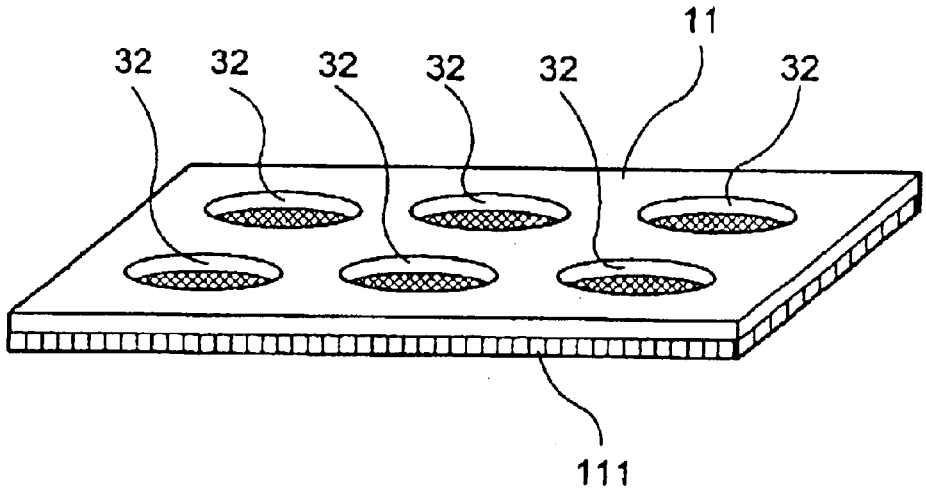
FIG. 12 is a perspective view showing a drumhead having apertures which is reinforced by a reinforce member.

(7) It is possible to use a sheet-shaped reinforce member 111 (see FIG. 12) which is adhered to the backside surface of the drumhead 11 of the foregoing embodiments. Herein, the reinforce member 111 can be formed by a thin sheet made of PET material, for example. It is preferable that the reinforce member 111 has properties not to substantially change gas permeability and striking feeling of the punching sheet corresponding to the drumhead 11. In other words, it is preferable that the reinforce member 111 does not completely close the apertures 32 of the drumhead 11. Concretely speaking, as the reinforce member 111, it is possible to use a cloth member being knit together with fibers of synthetic resin (e.g., PET), a sheet of a honeycomb structure and a mesh-formed sheet (see FIG. 12), for example. By provision of the reinforce member 111, it is possible to control reduction of strength of the drumhead 11 which is originally caused by formation of the apertures 32.

As this invention may be embodied in several forms without departing from the spirit of essential characteristics thereof, the present embodiments are therefore illustrative and not restrictive, since the scope of the invention is defined by the appended claims rather than by the description preceding them, and all changes that fall within metes and bounds of the claims, or equivalence of such metes and bounds are therefore intended to be embraced by the claims.

What is claimed is:

1. A drum, comprising:

a cylindrical drum body;

a drumhead supported by the drum body under tension, the drumhead comprising a non-woven sheet having a striking surface in which a plurality of through holes are formed;

a vibration absorption member for absorbing vibration of the drumhead when its striking surface is struck; and a support for holding the vibration absorption member in contact with a backside surface of the drumhead within the cylindrical drum body, wherein the support has a capability of vertically adjusting the position of the vibration absorption member along an interior periphery of the cylindrical drum body, so that the vibration absorption member can be moved into and out of contact with the backside surface of the drumhead.

2. A drum according to claim 1, wherein a sheet-shaped reinforce member is adhered to the backside surface of the drumhead.

3. A drum according to claim 1, wherein the non-woven sheet is made of plastic.

4. A drum according to claim 1, wherein the non-woven sheet has first and second flat opposing surfaces.

5. A drum according to claim 1, wherein the non-woven sheet is formed of a unitary member.

6. A drum according to claim 1, wherein the through holes in the non-woven sheet have diameters which range between several tenths millimeter and several millimeters.

7. A drum according to claim 6, wherein the through holes cover approximately 20% of the area of the striking surface of the drumhead.

8. A drum, comprising:

a cylindrical drum body;

a drumhead supported by the drum body under tension, the drumhead comprising a non-woven sheet having a striking surface in which a plurality of through holes are formed;

a vibration absorption member for absorbing vibration of the drumhead when its striking surface is struck; and a support holding the vibration absorption member contact a backside surface of the drumhead within the cylindrical drum body, wherein the vibration absorption member and the support structure are detachably attached to an inside of the cylinder, and wherein the support has a capability of vertically adjusting the position of the vibration absorption member along an interior periphery of the cylindrical drum body, so that the vibration absorption member can be moved into and out of contact with the backside surface of the drumhead.

9. A drum according to claim 8, wherein a sheet-shaped reinforce member is adhered to the backside surface of the drumhead.

10. A drum according to claim 8, wherein the non-woven sheet is made of plastic.

11. A drum according to claim 8, wherein the non-woven sheet is formed of a unitary member.

12. A drum according to claim 8, wherein the through holes in the non-woven sheet have diameters which range between several tenths millimeter and several millimeters.

13. A drum according to claim 12, wherein the through holes cover approximately 20% of the area of the striking surface of the drumhead.

14. A drum, comprising:

a cylindrical drum body;

a drumhead supported by the drum body under tension, the drumhead comprising a non-woven sheet having a striking surface in which a plurality of through holes are formed, each of the through holes having a diameter which ranges between several tenths milli-meter and several millimeters;

a vibration absorption member for absorbing vibration of the drumhead when the striking surface is struck; and a support for holding the vibration absorption member in contact with a backside surface of the drumhead, the vibration absorption member and the support being removably attached to an inside of the cylindrical drum body, wherein the support can vertically adjust the position of the vibration absorption member along an interior periphery of the cylindrical drum body, so that the vibration absorption member is selectively moved into and out of contact with the backside surface of the drumhead.

15. A drum according to claim 14, wherein the through holes cover approximately 20% of the total striking surface of the drumhead.

16. An electronic percussion instrument, comprising:

a cylindrical drum body;

a drumhead supported by the drum body under tension, the drumhead comprising a non-woven sheet having a striking surface in which a plurality of through holes are formed;

a vibration detection sensor for detecting vibration of the drumhead when its surface is struck and for generating an output signal as a function thereof;

a vibration absorption member; and a support for holding the vibration absorption member in contact with a backside surface of the drumhead within the cylinder, wherein the support comprises a plurality of L-shaped support members which are arranged along an interior periphery of the cylindrical drum body, a plurality of cushion materials, each of the cushion materials being located on a respective support member, and a support plate which is mounted on the support members by way of the cushion materials and on which the vibration absorption member is arranged, and wherein the vibration detection sensor is attached to approximately a center of a lower surface of the support plate.

17. A drum, comprising:

a cylindrical drum body;

a drumhead stretched over the drumhead under tension, the drumhead corresponding to a punching sheet having a striking surface in which a plurality of through holes are formed;

a vibration absorption member for absorbing vibration of the drumhead when its striking surface is struck, wherein a plurality of projections are formed on an upper surface of the vibration absorption member which is arranged to face a backside surface of the drumhead; and a support holding the vibration absorption member such that at least the upper surface of the projections contact the backside surface of the drumhead within the cylinder.

18. An electronic percussion instrument, comprising:

a cylindrical drum body;

a drumhead supported by the drum body under tension, the drumhead comprising a non-woven sheet having a striking surface in which a plurality of through holes are formed;

a vibration detection sensor for detecting vibration of the drumhead when its surface is struck and for generating an output signal as a function thereof;

a vibration absorption member having a plurality of projections formed on its upper surface; and a support for holding the vibration absorption member in contact with a backside surface of the drumhead within the cylinder such that at least the upper surfaces of the projections contact the backside surface of the drumhead.

* * * * *